US007562422B2

(12) United States Patent
D'Addario et al.

(10) Patent No.: US 7,562,422 B2
(45) Date of Patent: Jul. 21, 2009

(54) LOCKING FASTENER FOR A STRAP

(75) Inventors: James D'Addario, Old Westbury, NY (US); Robert Miller, Deer Park, NY (US)

(73) Assignee: Innovative Automation, Inc., Farmingdale, NY (US)

( * ) Notice: Subject to any disclaimer, the term of this patent is extended or adjusted under 35 U.S.C. 154(b) by 766 days.

(21) Appl. No.: 11/158,852

(22) Filed: Jun. 22, 2005

(65) Prior Publication Data

US 2005/0284282 A1 Dec. 29, 2005

Related U.S. Application Data

(60) Provisional application No. 60/583,417, filed on Jun. 28, 2004.

(51) Int. Cl.
*G10D 3/00* (2006.01)
*A41F 11/00* (2006.01)

(52) U.S. Cl. ..... 24/701; 84/327

(58) Field of Classification Search ..... 84/327
See application file for complete search history.

(56) References Cited

U.S. PATENT DOCUMENTS

| | | | | |
|---|---|---|---|---|
| 689,991 | A | 12/1901 | Rubin | |
| 703,878 | A | 7/1902 | Woodward | |
| 705,641 | A | 7/1902 | Britnell | |
| 828,573 | A | 8/1906 | Rubin | |
| 2,647,294 | A | 8/1953 | Davis | 24/223 |
| 3,743,147 | A | 7/1973 | Wilczynski | 224/26 |
| 4,357,063 | A | 11/1982 | Gray | 339/75 |
| 4,461,594 | A | 7/1984 | Waber | 403/59 |
| 4,556,133 | A | 12/1985 | Huber | 192/70.16 |
| 4,676,530 | A | 6/1987 | Nordgren et al. | 285/93 |
| 4,756,654 | A | 7/1988 | Clough | 411/437 |
| 4,767,246 | A | 8/1988 | Camloh et al. | 409/234 |
| 4,812,094 | A | 3/1989 | Grube | 411/134 |
| 4,901,900 | A | 2/1990 | Goto | 224/257 |
| 4,993,127 | A | 2/1991 | Mechem et al. | 24/701 |
| 5,193,368 | A | 3/1993 | Ling | 70/30 |
| 5,489,051 | A * | 2/1996 | Robinson | 224/148.4 |
| 5,746,334 | A | 5/1998 | Brandenberg | 211/205 |
| 5,868,293 | A | 2/1999 | D'Addario et al. | 224/257 |
| 6,032,339 | A | 3/2000 | D'Addario | 24/649 |
| 7,045,694 | B2 * | 5/2006 | Yasunori | 84/329 |

* cited by examiner

*Primary Examiner*—Jack W. Lavinder
(74) *Attorney, Agent, or Firm*—Gerald T. Bodner

(57) ABSTRACT

A locking fastener for a guitar strap which receives the end pin of a guitar includes a base plate and a locking plate which is reciprocatingly slidable on the base plate. The base plate has a pin receiving keyhole formed through its thickness which is defined by a widened opening and a narrowed opening. The base plate also has a central slot formed through its thickness and openings or detents which are spaced apart from one another. The locking plate has a front edge which is recessed to define an open pocket, at least one protrusion which is selectively received in the openings or detents to secure the locking plate in a desired position with respect to the base plate, and a knob post or handle which extends through the central slot of the base plate and which is graspable by a user. By sliding the locking plate with respect to the base plate, the user may effectively change the size of the pin receiving keyhole to secure or release the end pin of the guitar from the locking fastener and strap attached thereto.

20 Claims, 6 Drawing Sheets

LOCKING FASTENER FOR A STRAP

CROSS REFERENCE TO RELATED APPLICATION

This application is based on U.S. Provisional Application Ser. No. 60/583,417, which was filed on Jun. 28, 2004, and which is entitled "Locking Fastener for a Strap", the disclosure of which is incorporated herein by reference. Applicant hereby claims priority to the aforementioned application under 35 U.S.C. 120.

BACKGROUND OF THE INVENTION

1. Field of the Invention

The present invention relates to a locking fastener for attaching a strap to an article, and more particularly relates to a guitar strap fastener for removably attaching a guitar strap to a guitar.

2. Description of the Prior Art

Most guitars include an end pin for attaching at one end to a guitar strap. The end pin is generally formed with a shank extending from the guitar body and an enlarged diameter head mounted on the free end of the shank, such as the various end pins shown in FIG. 1 of U.S. Pat. No. 6,032,339, which issued to James D'Addario on Mar. 7, 2000, the disclosure of which is incorporated herein by reference. The end pin is received in an opening formed through the thickness of a leather or synthetic tab at the end of the strap, such as shown in FIG. 2 of the aforementioned James D'Addario patent. The opening has a radially extending cut to allow the end pin of the guitar to be forced into the opening so that the strap is held captive between the end pin head and the guitar body.

Without a locking mechanism attached to the keyhole slot formed in the strap, to keep the end pin shank properly in position within the slot portion of the strap keyhole, it is possible for the end pin to work its way free of the keyhole so that the strap inadvertently disengages from the guitar. One form of locking mechanism is described in the aforementioned patent to James D'Addario, in which a rotatable plate narrows the effective end pin receiving opening formed through the fastener to securely attach the guitar strap to the guitar.

OBJECTS AND SUMMARY OF THE INVENTION

It is an object of the present invention to provide a locking fastener for a guitar strap which cooperates with the end pins of existing guitars without any need for modification to the instrument.

It is another object of the present invention to provide a locking fastener for a guitar strap in which the locking mechanism is completely encased on both sides in leather or other protective material in order to protect the finish of the instrument and to simulate the look and feel of a conventional guitar strap.

It is a further object of the present invention to provide a locking mechanism for a guitar strap which securely locks the strap to the guitar and yet is easily lockable to and removable from the end pin of the user's guitar.

It is still a further object of the present invention to provide a locking fastener for a guitar strap which may be attached to and removed from the guitar by pushing and sliding the locking knob forming part of the locking fastener.

It is still another object of the present invention to provide a locking fastener for a guitar strap which is inexpensive to manufacture.

In accordance with one form of the present invention, a locking fastener for a strap includes a base plate having a main body portion. The main body portion includes an upper surface and an opposite lower surface. The base plate further has a keyhole formed through the thickness thereof between the upper surface and the lower surface. The keyhole is defined by a widened opening and a narrowed opening communicating with the widened opening.

The base plate of the locking fastener further includes a slot formed through the thickness thereof between the upper and lower surfaces. The base plate also includes a first opening or detent formed at least partially through the thickness thereof in the lower surface of the base plate, and a second opening or detent also formed at least partially through the thickness thereof in the lower surface of the base plate. The second opening or detent is spaced apart from the first opening or detent.

The locking fastener also includes a locking plate having an upper surface and an opposite lower surface. The locking plate is reciprocatingly slidable on the lower surface of the base plate, with the upper surface of the locking plate facing the lower surface of the base plate. The locking plate has a forward end and a rearward end situated longitudinally opposite the forward end. The forward end of the locking plate defines an open pocket formed through the thickness of the locking plate.

The upper surface of the locking plate includes at least one protrusion extending outwardly therefrom. The at least one protrusion is selectively received by one of the first opening and the second opening as the locking plate respectively slides on the base plate between at least a first position and a second position. The locking plate further includes a knob post situated thereon which extends outwardly from the upper surface thereof and through the slot of the base plate. The knob post is reciprocatingly movable in the slot of the base plate as the locking plate slidably moves thereon between the at least first position and the second position. The knob post preferably has mounted thereon a knob which is graspable by a user, so that the knob post is movable by the user to position the locking plate in the at least first position with respect to the base plate, wherein the open pocket of the forward end of the locking plate is in alignment with the widened opening of the keyhole formed in the base plate, and in the second position with respect to the base plate, wherein the open pocket of the forward end of the locking plate is aligned with the narrowed opening of the keyhole formed in the base plate. By moving the locking plate with respect to the base plate between the first position and the second position, the user may increase or reduce the overall size of the opening defined by the keyhole in the base plate in order for the locking fastener to captively hold in the keyhole, or release therefrom, a cooperating piece, such as the end pin mounted on a guitar or other musical instrument such as previously described.

The locking fastener of the present invention may further include an elongated cover piece which is preferably folded in half upon itself to define a bottom cover and a top cover disposed in an overlying relationship to the bottom cover. The top and bottom covers may be secured to one another by stitching or the like. The middle, folded-over portion of the elongated cover piece may be unstitched and thus define a bore running transversely between the top and bottom covers to receive a buckle or the like which, in turn, may receive and be attached to the end of a strap, such as a guitar strap. The top and bottom covers receive between them the base plate and locking plate, which are held captive therebetween. Each of the top and bottom covers may include keyholes similarly dimensioned to the keyhole formed in the base plate and positioned in alignment with one another and with the base plate keyhole so that the cooperating piece, such as the guitar end pin, may pass through the keyholes of the top and bottom covers and the base plate. The elongated cover piece, if included, further preferably includes a slot formed through the thickness of the top cover which is aligned with, and overlies, the slot formed in the base plate. The knob post extends through the top cover slot so that it is graspable by the user, or the slide knob affixed thereto is graspable by the user, and so that the user may move the locking plate with respect to the base plate between the first position and the second position so that the locking fastener of the present invention may receive or release the cooperating piece, such as the guitar end pin, within the aligned keyholes of the base plate and top and bottom covers, or hold the cooperating piece captive within the keyholes.

These and other objects, features and advantages of the present invention will be apparent from the following detailed description of illustrative embodiments thereof, which is to be read in connection with the accompanying drawings.

DETAILED DESCRIPTION OF THE PREFERRED EMBODIMENTS

Figure 1:
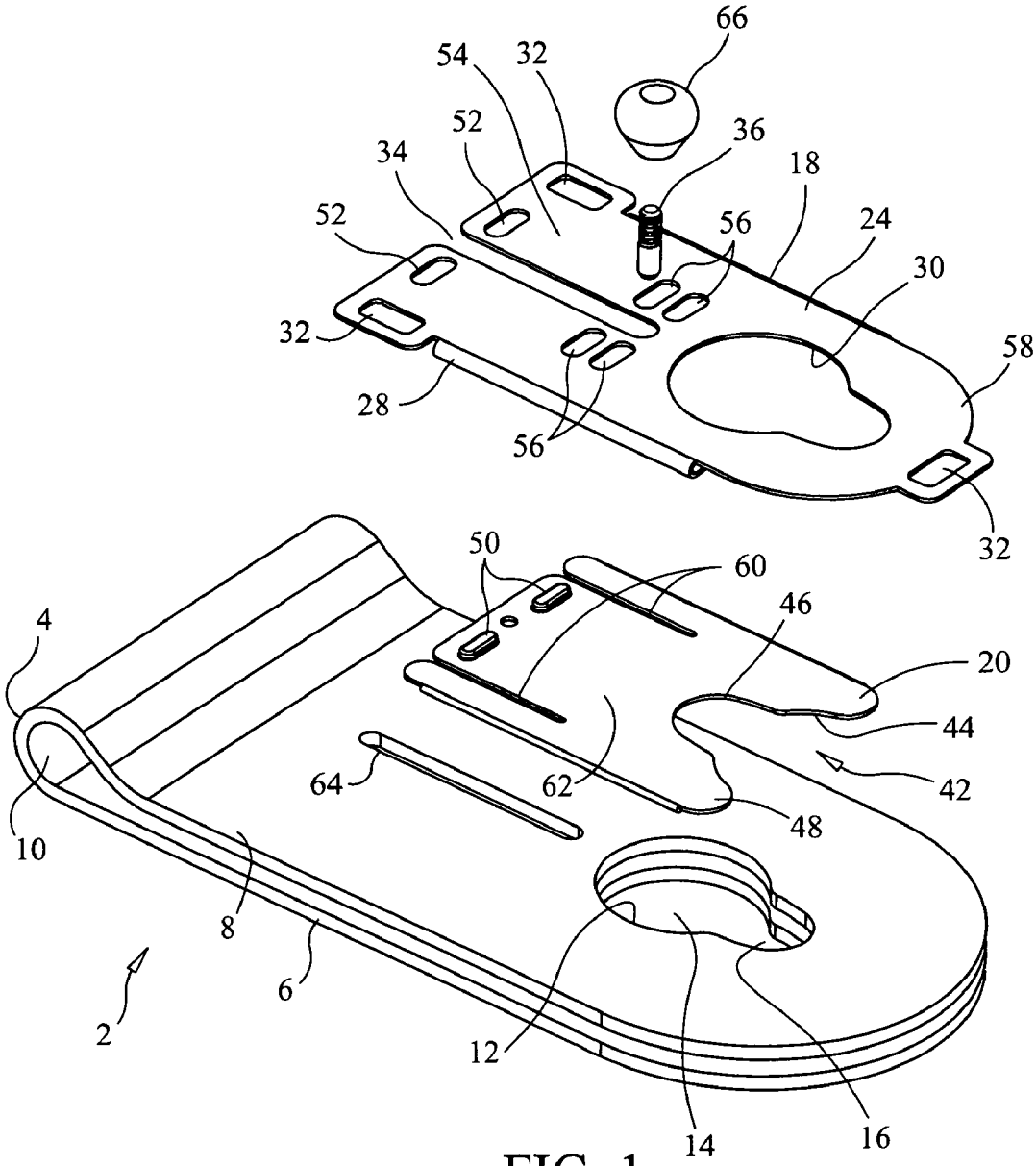
FIG. 1 is an exploded perspective view of a locking fastener formed in accordance with a first form of the present invention.
Figure 2:
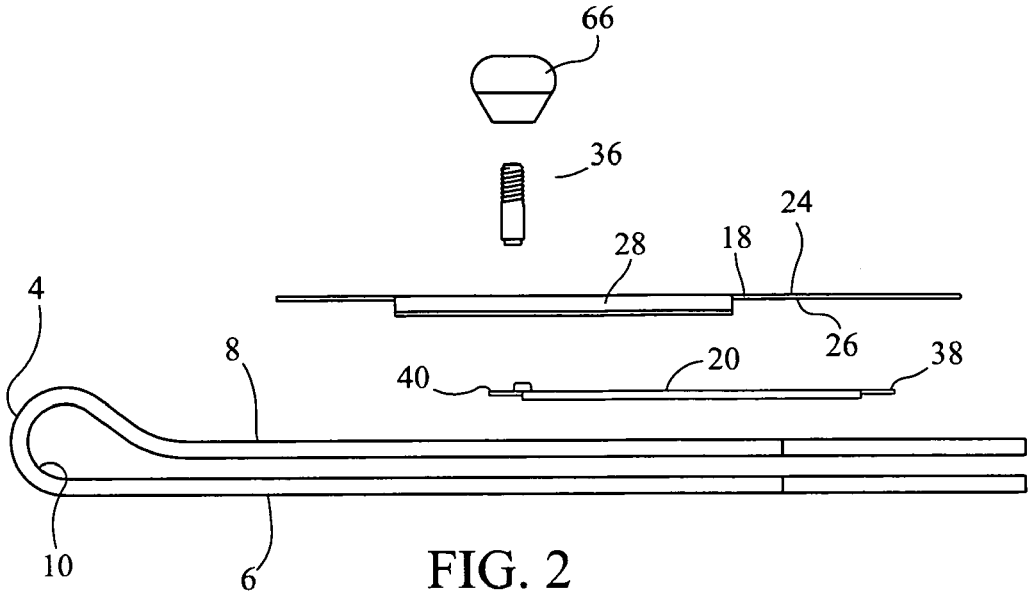
FIG. 2 is an exploded side view of the locking fastener formed in accordance with the first form of the present invention shown in FIG. 1.
Figure 3:
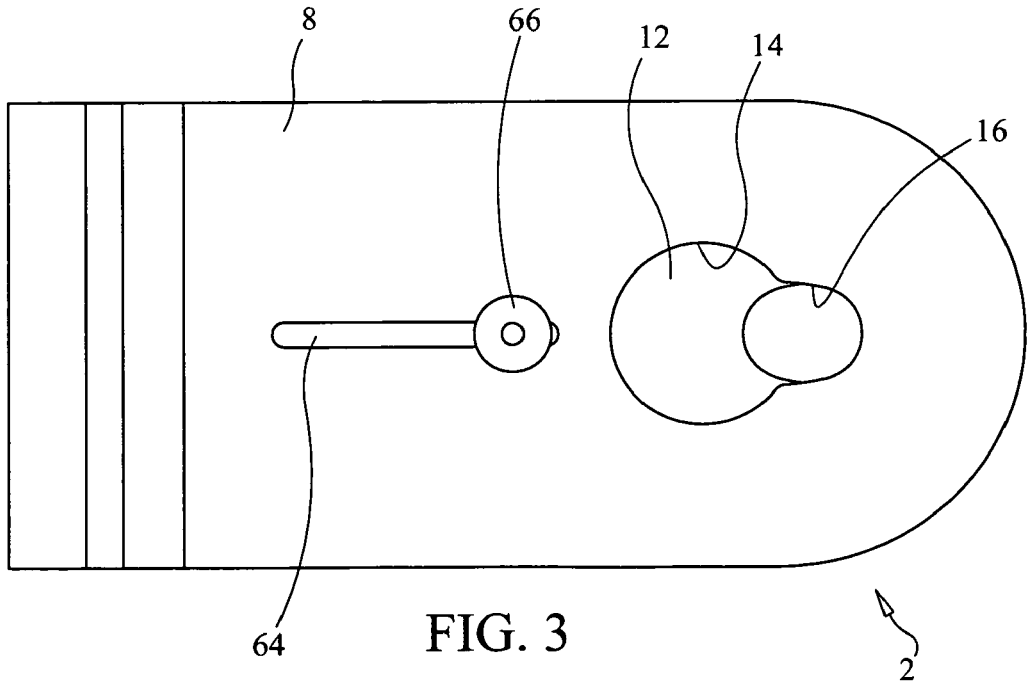
FIG. 3 is a top plan view of the locking fastener shown in FIGS. 1 and 2 and formed in accordance with the first form of the present invention.
Figure 4:
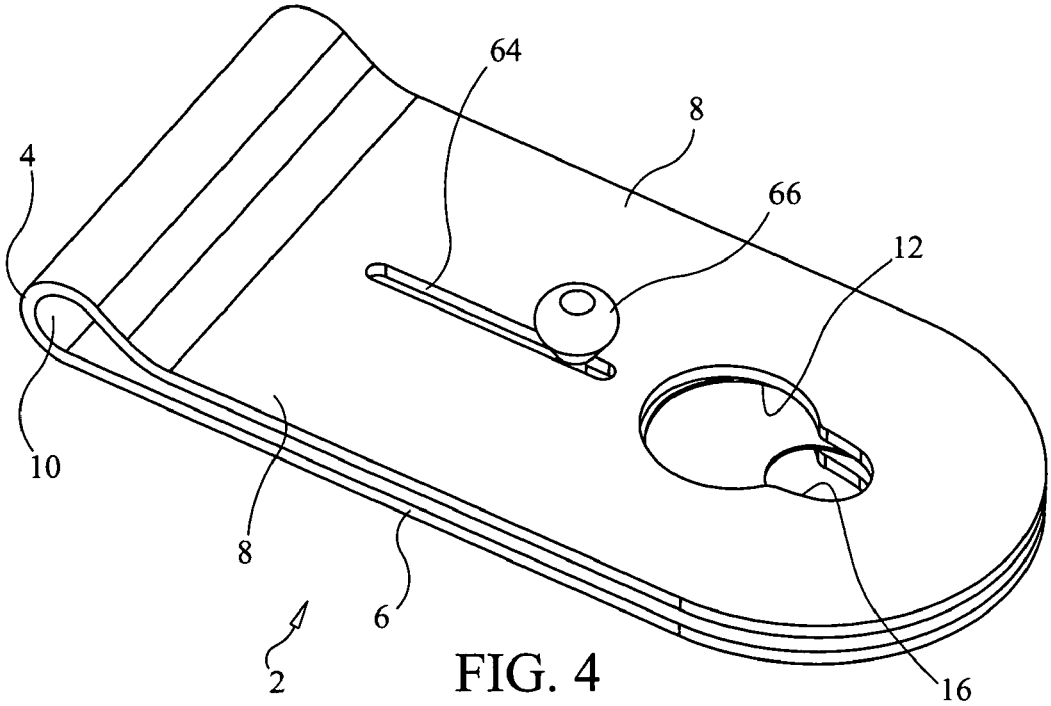
FIG. 4 is a perspective view of the assembled locking fastener formed in accordance with the first form of the present invention shown in FIG. 1.

Referring initially to FIGS. 1-4 of the drawings, it will be seen that a locking fastener 2 for a guitar strap, formed in accordance with a first form of the present invention, includes an elongated cover piece 4 made of leather or other synthetic or plastic material. The elongated cover piece 4 is preferably folded in half upon itself to define a bottom cover 6 and a top cover 8 disposed in an overlying relationship to the bottom cover 6. The top and bottom covers 8, 6 may be secured to one another by using any number of means or methods, including fasteners, such as rivets, or stitching, adhesives or the like. The middle, folded-over portion of the elongated cover piece 4 may be unstitched and thus define a bore 10 running transversely between the top and bottom covers 8, 6 to receive a buckle, D-ring, clip or the like (not shown) which may receive and be attached to the end of the guitar strap. Preferably, the end of the guitar strap is passed through the buckle, D-ring, clip or the like (collectively referred to herein as "buckle"), and is folded over onto itself and sewn or joined together to permanently affix the guitar strap to the locking fastener. Alternatively, a portion of the guitar strap itself may comprise the elongated cover piece 4 and may be folded over upon itself and secured by fasteners, stitching or the like to define the top cover 8 and bottom cover 6.

Each of the top and bottom covers 8, 6 includes keyholes 12 formed through the thickness thereof and positioned in alignment with one another. Each keyhole 12 is defined by an enlarged diameter circular opening portion 14, and a slot portion 16 radially extending from and communicating with the circular opening 14 and having a narrower transverse width. The diameter of the circular opening 14 is larger enough to receive the enlarged diameter head of the end pin affixed to the guitar to which the strap is to be attached. The transverse width of the slot portion 16 is less than the diameter of the head of the end pin but is greater than the diameter of the end pin shank. The end pin thus may be received by the circular openings 14 of the overlying cover keyholes 12 and slid into the narrower slot portions 16 of the keyholes so that the overlying top and bottom covers 8, 6 of the strap locking fastener 2 may be held captive between the end pin head and the guitar body.

Interposed between the top and bottom covers 8, 6 and held captive between them are a cooperating base plate 18 and a locking plate 20, each of which may be made of plastic or metal. The locking plate 20 slides reciprocatingly on the base plate 18 longitudinally over a portion of its length.

More specifically, the base plate 18 includes a main body portion 22 having an upper surface 24 and an opposite lower surface 26, and a pair of lateral side walls 28 extending perpendicularly from the lower surface 26 at opposite lateral sides of the main body portion 22. The locking plate 20 is fitted between the pair of lateral side walls 28 and slides reciprocatingly against the main body portion 22 between the lateral side walls. The lateral side walls 28 are provided to define a space between the top and bottom covers 8, 6 to ensure that the top and bottom covers, when sewn or fastened together, do not exert pressure on the locking plate 20 which would inhibit its movement.

The base plate 18 has a keyhole 30 formed through the thickness thereof. The base plate keyhole 30 is preferably dimensioned to be the same as or similar to the keyholes 12 formed in the top and bottom covers 8, 6, and is positioned to also be in alignment with the top and bottom cover keyholes 12 so that a keyhole-shaped opening is defined by the various keyholes 12, 30 through the entire cross-sectional thickness of the locking fastener 2 in order to receive the guitar end pin therethrough.

Holes or slots 32 may also be formed through the thickness of the base plate 18 to allow it to be sewn or otherwise secured to and between the top and bottom covers 8, 6. Further openings or detents 52, 56 may be formed through or in the base plate 18 to receive corresponding protrusions 50 formed on the locking plate 20 which are provided to help secure the locking plate to the base plate in either a locked position or an unlocked position, as will be described in greater detail.

The base plate 18 further has formed through the thickness thereof a slot 34 which extends centrally between the lateral edges and partially along the longitudinal length of the base plate. As will be seen, the slot 34 is provided to receive a handle, such as in the form of a rod or post, for grasping by the user, or a knob post 36 which extends through the base plate 18 and is connected to the locking plate 20, and has a transverse width which is slightly greater than the diameter of the knob post 36 to allow the post to move slidingly within the slot 34 between a locked position and an unlocked position.

The locking plate 20, as mentioned previously, is fitted between the lateral side walls 28 of the base plate 18 and slides reciprocatingly therebetween on the lower surface of the base plate. The locking plate 20 has a forward end 38 and a rearward end 40 situated longitudinally opposite the forward end 38.

The forward end 38 defines an open pocket 42 formed through the thickness of the locking plate 20, which open pocket 42 is dimensioned to receive the enlarged diameter head and narrower diameter shank of the guitar end pin and, as will be seen, works cooperatingly with the keyhole 30 of the base plate 18 to change the effective dimensions of the end pin receiving opening of the locking fastener 2 to selectively secure the locking fastener, and guitar strap attached to it, to the end pin of the guitar.

More specifically, the open pocket 42 of the locking plate 20 is formed with at least two, differently dimensioned portions. A first portion 44, nearest the leading edge of the forward portion 38, defining the entrance to the open pocket 42, has a widened, partially circular shape and is formed through the thickness of the locking plate 20. The diameter of this first portion 44 of the pocket 42 is substantially equal to or greater than the diameter of the circular portions of the base plate keyhole 30 and the top and bottom cover keyholes 12. Thus, the diameter of the first partially circular portion 44 of the locking plate 20 is greater than the diameter of the guitar end pin head so as not to obstruct the passage of the end pin head through the end pin receiving opening of the locking fastener 2 when the locking plate 20 is in the unlocked position with respect to the base plate 18.

A second portion 46 of the open pocket 42 of the locking plate 20 extends longitudinally inwardly from the leading edge of the forward portion 38 of the locking plate toward the rearward portion 40, and is in the shape of a slot communicating with the first portion 44 and formed through the thickness of the locking plate. The locking plate slot 46 has a transverse width which is the same as or similar to the slot portions of the keyholes 30, 12 formed in the base plate 18 and top and bottom covers 8, 6. In this way, the second portion 46 (i.e., the slot) of the locking plate 20 may receive the shank of the guitar end pin, and with the slot portions of the base plate keyhole 30 and top and bottom cover keyholes 12, define a closed end receiving slot which can hold the end pin shank captive therein when the locking plate 20 is in the locked position with respect to the base plate 18.

A top surface 48 of the locking plate 20, which faces the bottom surface 26 of the base plate 18, includes one or more protrusions 50 extending outwardly therefrom, which protrusions 50 are aligned with the cooperating detents or openings formed in the base plate. More specifically, a pair of protrusions 50 laterally spaced from each other is provided on the locking plate 20, and they are formed on the top surface 48 of the locking plate near the far edge of the rearward portion 40 of the locking plate. A first pair of laterally spaced openings or detents 52 are formed through or on the base plate 18 at a rear portion 54 thereof, and one or more second pairs of laterally spaced openings or detents 56 are formed through or on the base plate 18, but spaced a predetermined distance more inwardly from the rear portion 54 of the base plate and more toward the opposite front portion 58 of the base plate 18 (i.e., closer to the keyhole 30 in the base plate). The first pair of laterally spaced openings or detents 52 at least partially receives the respective protrusions 50 of the locking plate 20 to prevent the locking plate from inadvertently sliding with respect to the base plate 18 when the locking plate is in the unlocked position. The second pair or pairs of laterally spaced openings or detents 56 at least partially receive the locking plate protrusions 50 to prevent the locking plate 20 from inadvertently sliding with respect to the base plate 18 when the locking plate is in the locked position. Two second pairs of openings or detents 56 are preferably provided to accommodate end pins having different diameter shanks.

The locking plate 20 further has a pair of slits 60 formed through its thickness and extending longitudinally partially along the length thereof. Each slit 60 is formed near an opposite lateral edge of the locking plate to define a resilient central tab portion 62 on which the two lateral protrusions 50 reside. The resilient central tab portion 62 is biased upwardly toward the bottom side 26 of the base plate to ensure that the protrusions 50 engage the base plate 18 and are resiliently received by the first pair and second pair or pairs of openings or detents 52, 56 formed through or in the base plate 18 when the locking plate 20 is respectively in the unlocked position and the locked position.

The knob post 36 is attached to the locking plate 20 on its rearward portion 40 and extends perpendicularly upwardly from the top surface 48 of the locking plate. As mentioned previously, the knob post 36 passes through the slot 34 formed in the base plate 18. The post 36 also extends through a slot 64 formed through the thickness of the top cover 8 and is reciprocatingly slidable therein. A slide knob 66 is affixed to the free end of the knob post 36 and extends outwardly above the top surface of the top cover 8 so that it may be easily grasped by a user.

In operation, the locking fastener 2 is placed by the user in its unlocked position by the user grasping the slide knob 66 and moving it away from the keyhole-shaped end pin receiving opening. This movement will correspondingly move the locking plate 20 with respect to the base plate 18 away from the keyhole 30 formed through the base plate so that the partially circular first portion 44 of the open pocket 42 is in alignment with the enlarged diameter circular portions of the keyholes 30, 12 of the base plate 18 and the top and bottom covers 8, 6. The user now places the locking fastener 2, with the guitar strap attached thereto, to the guitar by passing the enlarged head of the guitar end pin through the enlarged diameter circular portion of the keyhole-shaped end pin receiving opening formed through the locking fastener 2. The user then maneuvers the end pin such that its shank is received by the slot portion of the keyhole-shaped end pin receiving opening.

Then, the user grasps the slide knob 66 of the locking fastener 2 and pushes it toward the keyhole opening so that the locking plate 20 slides from its unlocked position to its locked position with respect to the base plate 18. This causes the slot-shaped second portion 46 of the open pocket 42 formed in the locking plate to advance through the enlarged diameter circular opening of the keyhole-shaped end pin receiving opening formed through the locking fastener 2 to thereby define with the keyholes 30, 12 formed in the base plate 18 and top and bottom covers 8, 6 a closed ended slot having a smaller diameter than that of the head of the guitar end pin, through which slot passes the shank of the end pin. By moving the slide knob 66 from one end of the slot 64 formed in the top cover 8 to the other end, the user forces the protrusions 50 on the locking plate 20 out of the first set of openings or detents 52 formed through or in the base plate to and into the second pair of openings or detents 56, which maintain the locking plate 20 in its locked position with respect to the base plate 18. Accordingly, the guitar end pin is held captive in the narrower slot portion of the keyhole-shaped end pin receiving opening of the locking fastener 2 to ensure that the strap does not inadvertently become disengaged from the guitar end pin.

The user may quickly and easily remove the strap from the guitar by sliding the knob 66 backward away from the keyhole-shaped end pin receiving opening so that the enlarged head of the end pin may now pass through the circular portion of the keyhole-shaped end pin receiving opening of the locking fastener.

Figure 5:
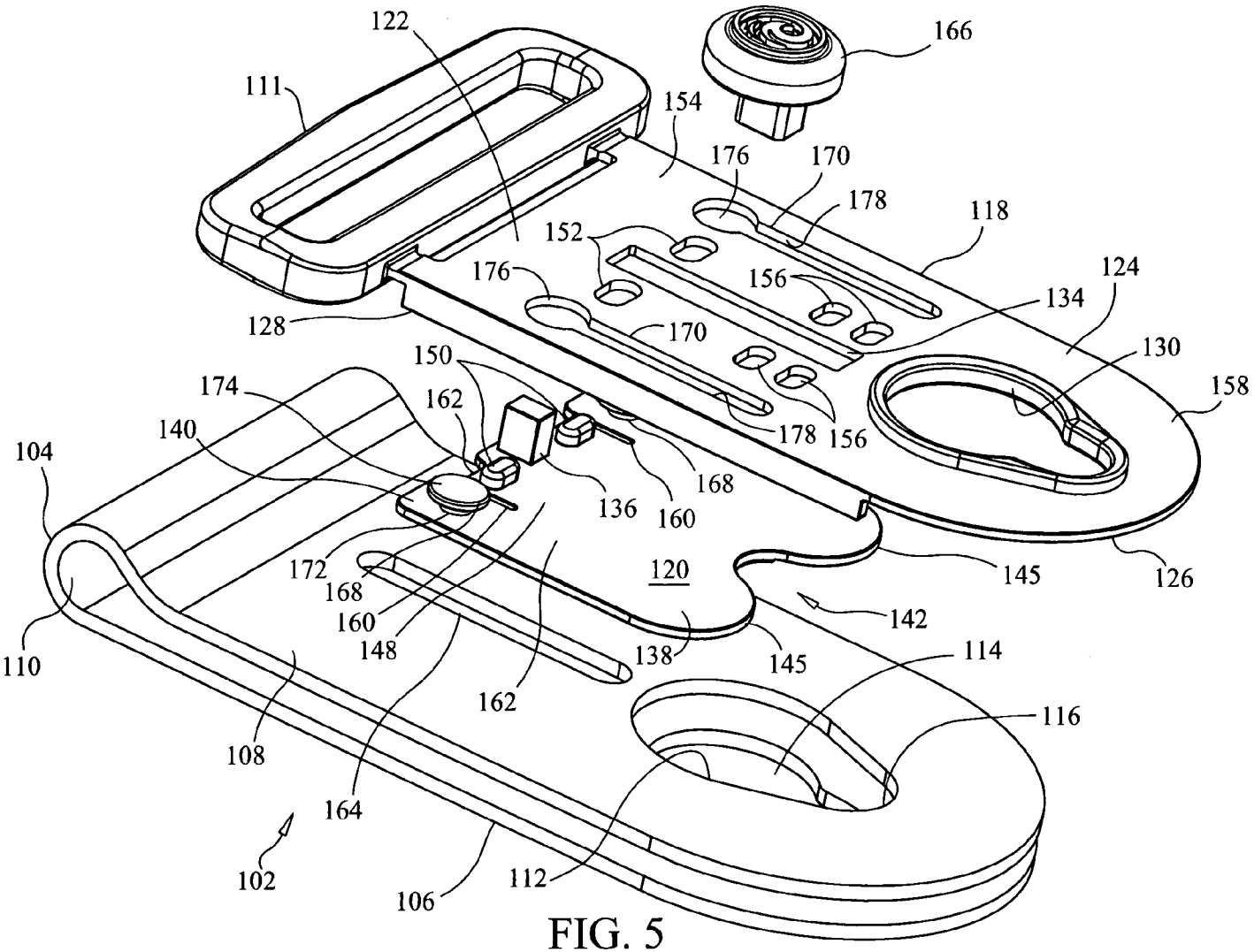
FIG. 5 is an exploded perspective view of a locking fastener formed in accordance with a second form of the present invention.
Figure 6:
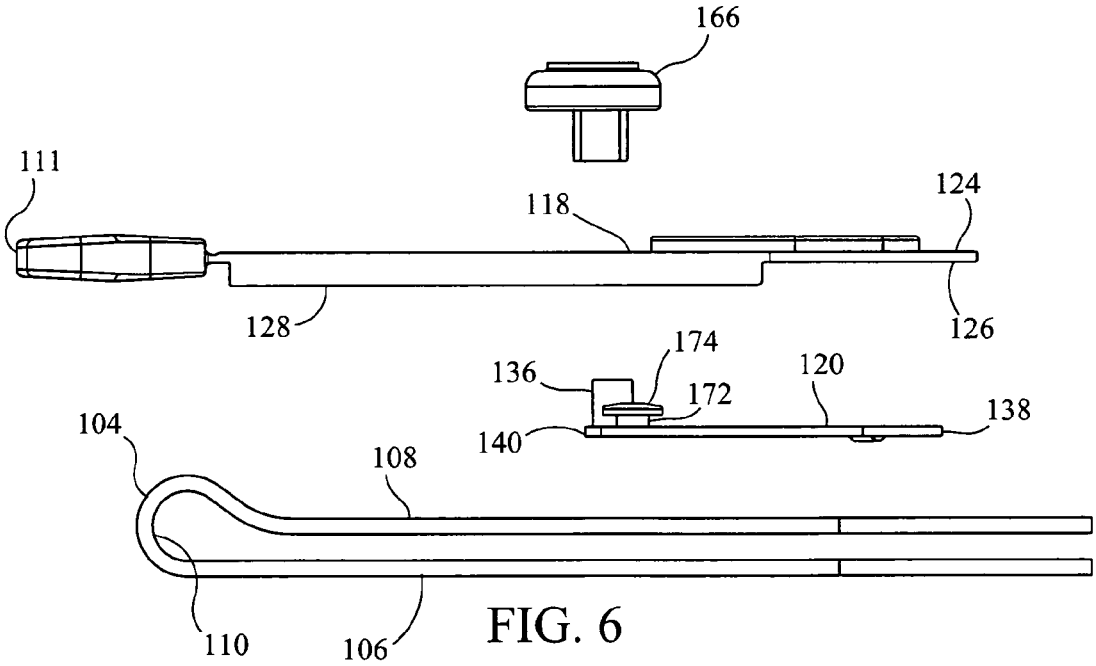
FIG. 6 is an exploded side view of the locking fastener formed in accordance with the second form of the present invention shown in FIG. 5.
Figure 7:
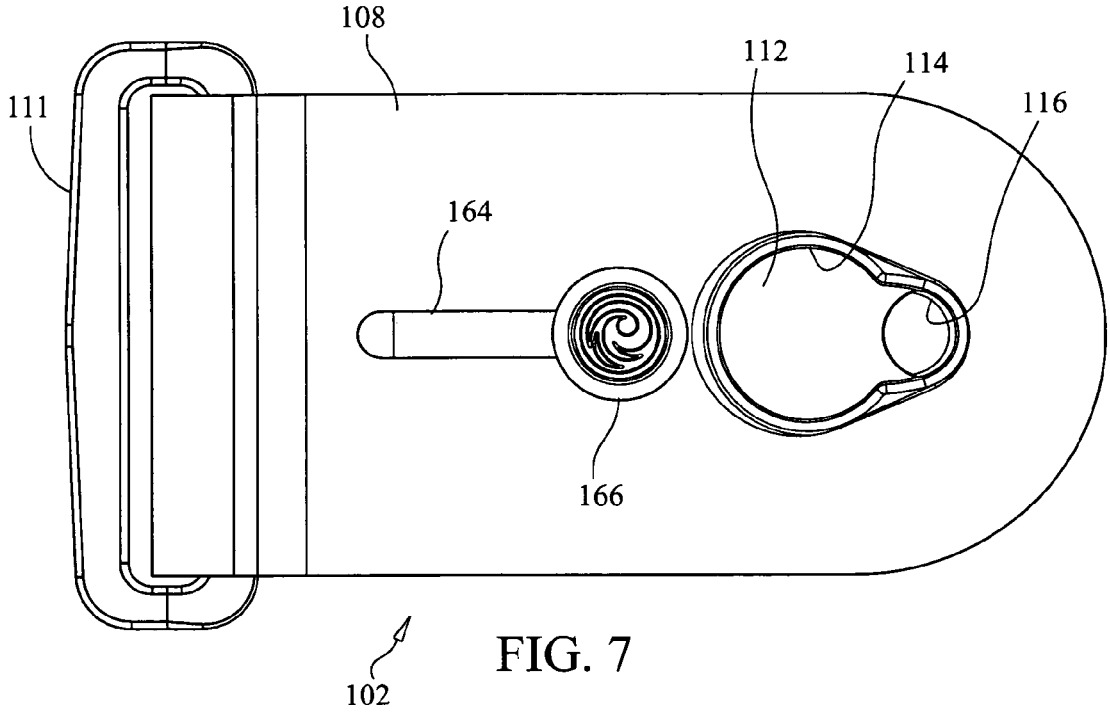
FIG. 7 is a top plan view of the locking fastener shown in FIGS. 5 and 6 and formed in accordance with the second form of the present invention.
Figure 8:
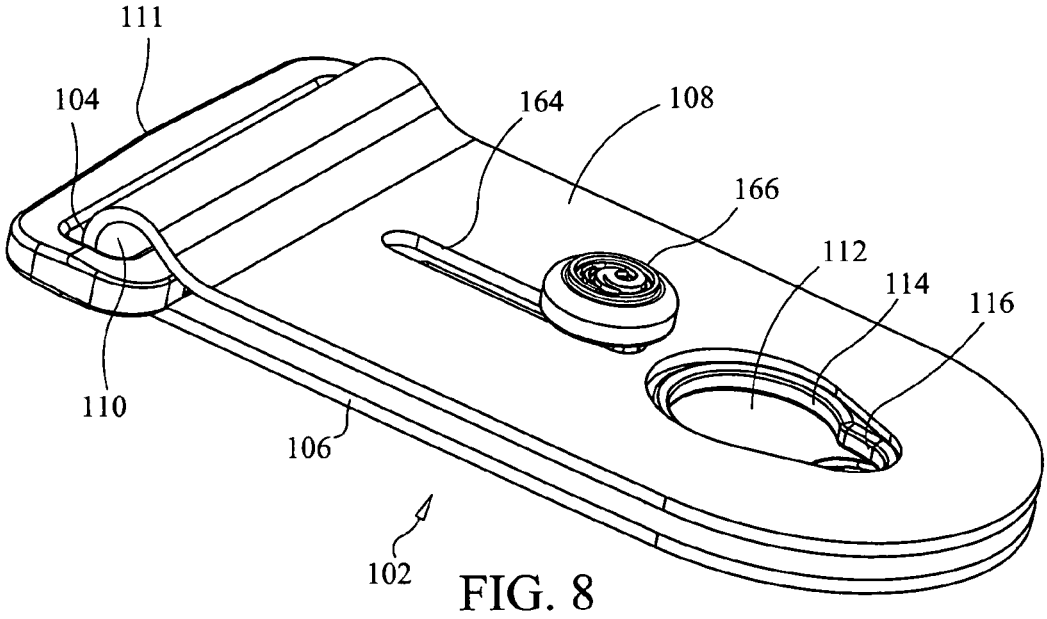
FIG. 8 is a perspective view of the assembled locking fastener formed in accordance with the second form of the present invention shown in FIG. 5.

Referring now to FIGS. 5-8 of the drawings, it will be seen that a locking fastener 102 for a guitar strap, formed in accordance with a second form of the present invention, includes an elongated cover piece 104 made of leather or other synthetic or plastic material. The elongated cover piece 104 is preferably folded in half upon itself to define a bottom cover 106 and a top cover 108 disposed in an overlying relationship to the bottom cover 106. The top and bottom covers 108, 106 may be secured to one another by using any number of means or methods, including fasteners, such as rivets, or stitching, adhesives or the like. The middle, folded-over portion of the elongated cover piece 104 may be unstitched and thus define a bore 110 running transversely between the top and bottom covers 108, 106 to receive a buckle 111, D-ring, clip or the like (collectively referred to herein as "buckle") which may receive and be attached to the end of the guitar strap. Preferably, the end of the guitar strap is passed through the buckle 111, D-ring, clip or the like, and is folded over onto itself and sewn or joined together to permanently affix the guitar strap to the locking fastener. Alternatively, a portion of the guitar strap itself may comprise the elongated cover piece 104 and may be folded over upon itself and secured by fasteners, stitching or the like to define the top cover 108 and bottom cover 106.

Each of the top and bottom covers 108, 106 includes keyholes 112 formed through the thickness thereof and positioned in alignment with one another. Each keyhole 112 is defined by an enlarged diameter circular opening portion 114, and a slot portion 116 radially extending from and communicating with the circular opening 114 and having a narrower transverse width. The diameter of the circular opening 114 is larger enough to receive the enlarged diameter head of the end pin affixed to the guitar to which the strap is to be attached. The transverse width of the slot portion 116 is less than the diameter of the head of the end pin but is greater than the diameter of the end pin shank. The end pin thus may be received by the circular openings 114 of the overlying cover keyholes 112 and slid into the narrower slot portions 116 of the keyholes so that the overlying top and bottom covers 108, 106 of the strap locking fastener 102 may be held captive between the end pin head and the guitar body.

Interposed between the top and bottom covers 108, 106 and held captive between them are a cooperating base plate 118 and a locking plate 120, each of which may be made of plastic or metal. The locking plate 120 slides reciprocatingly on the base plate 118 longitudinally over a portion of its length.

More specifically, the base plate 118 includes a rear portion 154 and a front portion 158 situated longitudinally opposite the rear portion 154. Preferably, the rear portion 154 is joined to, and integrally formed with, the buckle 111, the buckle 111 preferably residing co-planarly with the base plate 118. The base plate 118 further includes a main body portion 122 having an upper surface 124 and an opposite lower surface 126, and a pair of lateral side walls 128 extending perpendicularly from the lower surface 126 at opposite lateral sides of the main body portion 122. The locking plate 120 is fitted between the pair of lateral side walls 128 and slides reciprocatingly against the main body portion 122 between the lateral side walls. The lateral side walls 128 are provided to define a space between the top and bottom covers 108, 106 to ensure that the top and bottom covers, when sewn or fastened together, do not exert pressure on the locking plate 120 which would inhibit its movement.

The base plate 118 has a keyhole 130 formed through the thickness thereof. The base plate keyhole 130 is preferably dimensioned to be the same as or similar to the keyholes 112 formed in the top and bottom covers 108, 106, and is positioned to also be in alignment with the top and bottom cover keyholes 112 so that a keyhole-shaped opening is defined by the various keyholes 112, 130 through the entire cross-sectional thickness of the locking fastener 102 in order to receive the guitar end pin therethrough.

Openings or detents 152, 156 may be formed through or in the base plate 118 to receive corresponding protrusions 150 formed on the locking plate 120 which are provided to help secure the locking plate to the base plate in either a locked position or an unlocked position, as will be described in greater detail.

The base plate 118 further has formed through the thickness thereof a slot 134 which extends centrally between the lateral edges and partially along the longitudinal length of the base plate. As will be seen, the slot 134 is provided to receive a knob post 136 which extends through the base plate 118 and is connected to the locking plate 120, and has a transverse width which is slightly greater than the diameter of the knob post 136 to allow the post to move slidingly within the slot 134 between a locked position and an unlocked position.

The locking plate 120, as mentioned previously, is fitted between the lateral side walls 128 of the base plate 118 and slides reciprocatingly therebetween on the lower surface of the base plate. The locking plate 120 has a forward end 138 and a rearward end 140 situated longitudinally opposite the forward end 138.

The forward end 138 defines an open pocket 142 formed through the thickness of the locking plate 120, which open pocket 142 is dimensioned to receive the enlarged diameter head and narrower diameter shank of the guitar end pin and, as will be seen, works cooperatingly with the keyhole 130 of the base plate 118 to change the effective dimensions of the end pin receiving opening of the locking fastener 102 to selectively secure the locking fastener, and guitar strap attached to it, to the end pin of the guitar.

More specifically, the open pocket 142 of the locking plate 120 is defined by and between two rounded, laterally spaced apart tongues 145 situated at the forward portion 138 of the locking plate 120 and further defining the leading edge of the forward portion 138, the leading edge being recessed centrally between the two tongues to form the pocket 142. The rounded edges of the tongues 145 help direct the end pin of the guitar, or other cooperating structure, into the open pocket 142 as the locking plate 120 is moved to its closed or locking position. The tongues 145 and open pocket 142 of the locking plate 120 are dimensioned and positioned on the locking plate so as not to obstruct the passage of the end pin head through the end pin receiving opening of the locking fastener 102 when the locking plate 120 is in the unlocked position with respect to the base plate 118.

The open pocket 142 of the locking plate 120 may receive the shank of the guitar end pin, and the recessed leading edge of the forward portion 138 and the slot portions of the base plate keyhole 130 and top and bottom cover keyholes 112 together define a closed end receiving slot which can hold the end pin shank captive therein when the locking plate 120 is in the locked position with respect to the base plate 118.

A top surface 148 of the locking plate 120, which faces the bottom surface 126 of the base plate 118, includes one or more protrusions 150 extending outwardly therefrom, which protrusions 150 are aligned with the cooperating detents or openings formed in the base plate. More specifically, a pair of protrusions 150 laterally spaced from each other is provided on the locking plate 120, and they are formed on the top surface 148 of the locking plate near the far edge of the rearward portion 140 of the locking plate. A first pair of laterally spaced openings or detents 152 are formed through or on the base plate 118 at a rear portion 154 thereof, and one or more second pairs of laterally spaced openings or detents 156 are formed through or on the base plate 118, but spaced a predetermined distance more inwardly from the rear portion 154 of the base plate and more toward the opposite front portion 158 of the base plate 118 (i.e., closer to the keyhole 130 in the base plate). The first pair of laterally spaced openings or detents 152 at least partially receives the respective protrusions 150 of the locking plate 120 to prevent the locking plate from inadvertently sliding with respect to the base plate 118 when the locking plate is in the unlocked position. The second pair or pairs of laterally spaced openings or detents 156 at least partially receive the locking plate protrusions 150 to prevent the locking plate 120 from inadvertently sliding with respect to the base plate 118 when the locking plate is in the locked position. Two second pairs of openings or detents 156 are preferably provided to accommodate end pins having different diameter shanks.

The locking plate 120 further has a pair of slits 160 formed through its thickness and extending longitudinally partially along the length thereof. Each slit 160 is formed near an opposite lateral edge of the locking plate to define a resilient central tab portion 162 on which the two lateral protrusions 150 reside. The resilient central tab portion 162 is biased upwardly toward the bottom side 126 of the base plate to ensure that the protrusions 150 engage the base plate 118 and are resiliently received by the first pair and second pair or pairs of openings or detents 152, 156 formed through or in the base plate 118 when the locking plate 120 is respectively in the unlocked position and the locked position.

The knob post 136, which could itself act as a handle that is graspable by a user, is attached to the locking plate 120 on its rearward portion 140 and extends perpendicularly upwardly from the top surface 148 of the locking plate. As mentioned previously, the knob post 136 passes through the slot 134 formed in the base plate 118. The post 136 also extends through a slot 164 formed through the thickness of the top cover 108 and is reciprocatingly slidable therein. Optionally, a slide knob 166 is affixed by gluing or the like to the free end of the knob post 136 and extends outwardly above the top surface of the top cover 108 so that it may be easily grasped by a user.

In this second embodiment of the present invention shown in FIGS. 5-8, the knob post 136 is shown as a rectangular boss extending perpendicularly from the top surface 148 of the locking plate 120. The rectangular boss (i.e., the knob post 136) acts as a stop, and limits the rearward movement of the locking plate 120 with respect to the base plate 118 (i.e., in a direction toward buckle 111) by engaging the base plate 118 at the rearward end of slot 134. It should be noted that in the first embodiment of the present invention shown in FIGS. 1-4, slot 34 of base plate 18 is open at its rearward end, that is, at the rearmost edge of the rear portion 54 of the base plate 18. In the second embodiment of the present invention shown in FIGS. 5-8, the slot 134 is closed at both of its longitudinal ends, with the rectangular boss (i.e., the knob post 136) sliding reciprocatingly within the limited confines of the slot 134.

Another distinction between the second embodiment of the present invention shown in FIGS. 5-8 and the first embodiment shown in FIGS. 1-4 is the inclusion in the second embodiment of mushroom-shaped projections 168 on the locking plate 120 and cooperating elongated keyhole slots 170 formed in the base plate 118 for receiving and retaining therein the mushroom-shaped projections 168.

More specifically, a pair of spaced-apart, mushroom-shaped projections 168, each having a shank 172 and an enlarged head 174 mounted on the free end of the shank 172, extends perpendicularly from the top surface 148 of the locking plate 120 on each side of the central portion 162, that is, each being situated between the slits 160 and a respective lateral edge of the locking plate 120, near the rearward end of the locking plate. Correspondingly, a pair of spaced apart, elongated keyhole slots 170 are formed through the thickness of the base plate 118, each keyhole slot 170 being positioned near a respective lateral edge of the base plate. The keyhole slots 170 have an enlarged diameter circular opening portion 176 and a slot portion 178 extending from and communicating with the circular opening 176 in the longitudinal direction of the base plate toward the front portion 158 thereof and having a narrower transverse width.

The diameter of the circular opening 176 of each keyhole slot 170 is greater than that of the enlarged head 174 of each mushroom-shaped projection 168 of the locking plate 120, and the transverse width of the slot portion 178 of each keyhole slot 170 is less than the diameter of the enlarged head 174 but greater than that of the shank 172 of each mushroom-shaped projection 168. The keyhole slots 170 are spaced apart from each other the same distance as the spacing between the projections 168 so that they may receive and hold captive therein the corresponding projections of the locking plate 120 when the locking plate 120 and base plate 118 are assembled together.

To assemble the locking plate 120 to the base plate 118, the enlarged head 174 of the mushroom-shaped projections 168 are forced into the corresponding circular openings 176 of the keyhole slots 170, the lateral portions of the locking plate 120 being slightly bent upwardly toward the base plate 120 due to the resiliency of the locking plate provided by the slits 160 formed therein. At this stage of assembly of the locking plate 120 and base plate 118, the knob post 136, which projects from the top surface 148 of the locking plate, is situated beyond the far end of the central slot 134 and is not aligned with or received thereby. Once received by the circular openings 176, the mushroom-shaped projections, and in particular the shanks 172 thereof, are slid into and received by the slot portions 178 of the keyhole slots 170. The knob post 136 will now come into alignment with the central slot 134 and will be biasedly received by the central slot due to the resiliency of the central tab portion 162 of the base plate 118 resulting from slits 160.

The knob post 136 reciprocatingly slides in the central slot 134 and, similarly, the mushroom-shaped projections 168 reciprocatingly slide in the slot portions of their respective keyhole slots 170. The locking plate 120 and base plate 118 are held together by the projections 168 remaining captive in the keyhole slots 170. As the knob 166 is moved as far rearward as permitted, away from the keyhole opening in the locking fastener, the knob post 136, acting as a stop, engages the rearward-most end of the central slot 134 before the enlarged head 174 of the projections 168 reaches the circular openings 176 of the keyhole slots 170. Thus, the projections 168 remain captive in the slot portions 178 of the keyhole slots 170, thereby securing the locking plate 120 to the base plate 118 while permitting the locking plate to slide reciprocatingly on the base plate.

After the locking plate 120 and the base plate 118 are assembled, the elongated cover piece 104 is passed through the buckle 111 affixed to the base plate 118, and then folded in half upon itself to encompass the assembly, with the top cover 108 disposed in overlying relationship to the bottom cover 106, and with the assembled locking plate 120 and base plate 118 interposed therebetween. The edges of the top and bottom covers 108, 106 are then fastened together by gluing, stitching, fasteners or the like to secure the assembled locking plate 120 and base plate 118 therebetween. The middle, folded-over portion of the elongated cover piece 104 remains unstitched to define the bore 110 running transversely between the top and bottom covers 108, 106, which bore 110 receives and holds in place a portion of the buckle 111. The buckle 111 receives and may be attached to the end of the strap to which the locking fastener is attached.

In operation, the locking fastener 102 is placed by the user in its unlocked position by the user grasping the slide knob 166 and moving it away from the keyhole-shaped end pin receiving opening. This movement will correspondingly move the locking plate 120 with respect to the base plate 118 away from the keyhole 130 formed through the base plate so that the open pocket 142 of the locking plate 120 is in alignment with the enlarged diameter circular portions of the keyholes 130, 112 of the base plate 118 and the top and bottom covers 108, 106. The user now places the locking fastener 102, with the guitar strap attached thereto, to the guitar by passing the enlarged head of the guitar end pin through the enlarged diameter circular portion of the keyhole-shaped end pin receiving opening formed through the locking fastener 102. The user then maneuvers the end pin such that its shank is received by the slot portion of the keyhole-shaped end pin receiving opening.

Then, the user grasps the slide knob 166 of the locking fastener 102 and pushes it toward the keyhole opening so that the locking plate 120 slides from its unlocked position to its locked position with respect to the base plate 118. This causes the open pocket 142 formed in the locking plate to advance through the enlarged diameter circular opening of the keyhole-shaped end pin receiving opening formed through the locking fastener 102 so that the tongues 145 and leading edge of the forward portion 138 of the locking plate 120 define with the keyholes 130, 112 formed in the base plate 118 and top and bottom covers 108, 106 a closed ended slot having a smaller diameter than that of the head of the guitar end pin, through which slot passes the shank of the end pin. By moving the slide knob 166 from one end of the slot 164 formed in the top cover 108 to the other end, the user forces the protrusions 150 on the locking plate 120 out of the first set of openings or detents 152 formed through or in the base plate to and into the second pair of openings or detents 156, which maintain the locking plate 120 in its locked position with respect to the base plate 118. Accordingly, the guitar end pin is held captive in the narrower slot portion of the keyhole-shaped end pin receiving opening of the locking fastener 102 to ensure that the strap does not inadvertently become disengaged from the guitar end pin.

The user may quickly and easily remove the strap from the guitar by sliding the knob 166 backward away from the keyhole-shaped end pin receiving opening so that the enlarged head of the end pin may now pass through the circular portion of the keyhole-shaped end pin receiving opening of the locking fastener.

It should be understood that the structure of the locking plate 20, 120 may be interchanged with the cooperating structure of the base plate 18, 118. For example, the mushroom-shaped projections 168 of the second embodiment shown in FIGS. 5-8 may be situated on the base plate 118, and the cooperating keyhole slots 170 may be formed in the locking plate 120. Similarly, the protrusions 50, 150 of the first and second embodiments shown in FIGS. 1-4 and FIGS. 5-8, respectively, may be situated on the base plate 18, 118 and the corresponding detents or openings 52, 56, 152, 156 may be situated on the locking plate 20, 120. Also, it should be understood that reference in the claims to the detents or openings 52, 56, 152, 156 is collectively provided by using the term "opening."

Although illustrative embodiments of the present invention have been described herein with reference to the accompanying drawings, it is to be understood that the invention is not limited to those precise embodiments, and that various other changes and modifications may be effected therein by one skilled in the art without departing from the scope or spirit of the invention.

What is claimed is:

1. A locking fastener for a strap, which comprises:

a base plate having a main body portion, the main body portion having a first surface and an opposite second surface, the base plate having a keyhole formed through the thickness thereof between the first and second surfaces, the keyhole being defined by a widened opening and a narrowed opening communicating with the widened opening, the base plate further having a first slot formed through the thickness thereof between the first and second surfaces, the base plate further having a first opening formed at least partially through the thickness thereof in the second surface thereof, and a second opening formed at least partially through the thickness thereof in the second surface thereof, the second opening being spaced apart from the first opening; and a locking plate having a first surface and an opposite second surface, the locking plate being reciprocatingly slidable on the second surface of the base plate, with the first surface of the locking plate facing the second surface of the base plate, the locking plate having a forward end and a rearward end situated longitudinally opposite the forward end, the forward end of the locking plate defining an open pocket formed through the thickness of the locking plate, the first surface of the locking plate including at least one protrusion extending outwardly therefrom, the at least one protrusion being selectively received by one of the first opening and the second opening as the locking plate respectively slides on the base plate between at least a first position and a second position, the locking plate further having situated thereon a knob post extending outwardly from the first surface thereof and through the first slot of the base plate, the knob post being reciprocatingly movable in the first slot of the base plate as the locking plate slidably moves thereon between the at least first position and the second position, the knob post being movable by the user to position the locking plate in the at least first position with respect to the base plate, wherein the open pocket of the forward end of the locking plate is in alignment with the widened opening of the keyhole formed in the base plate, and in the second position with respect to the base plate, wherein the open pocket of the forward end of the locking plate is in alignment with the narrowed opening of the keyhole formed in the base plate.

2. A locking fastener for a strap as defined by claim 1, which further comprises:

a top cover and a bottom cover, the top cover being disposed in overlying relationship to the bottom cover, the locking plate and the base plate being interposed between the top and bottom covers.

3. A locking fastener for a strap as defined by claim 2, wherein the locking fastener includes an elongated cover piece which is folded upon itself to define the top cover and the bottom cover.

4. A locking fastener for a strap as defined by claim 3, which further comprises:

a strap buckle, the strap buckle being secured to the elongated cover piece.

5. A locking fastener for a strap as defined by claim 2, which further comprises:

a strap buckle, the strap buckle being secured to at least one of the top cover and the bottom cover.

6. A locking fastener for a strap as defined by claim 1, which further comprises:

a strap buckle, the strap buckle being affixed to the base plate.

7. A locking fastener for a strap as defined by claim 1, which further comprises:

a knob, the knob being mounted on the knob post.

8. A locking fastener for a strap as defined by claim 1, wherein the base plate includes a pair of lateral side walls extending perpendicularly from the second surface of the main body portion at opposite lateral sides thereof, the locking plate being fitted between the pair of lateral side walls and being reciprocatingly slidable between the lateral side walls.

9. A locking fastener for a strap as defined by claim 1, wherein the knob post engages the base plate at longitudinal ends of the first slot formed therein thereby acting as a stop to limit movement of the locking plate with respect to the base plate between the first position and the second position.

10. A locking fastener for a strap as defined by claim 1, wherein the locking plate has formed through the thickness thereof a pair of slits which extend longitudinally at least partially along the length thereof, the slits defining therebetween a central tab portion on which the at least one protrusion resides.

11. A locking fastener for a strap as defined by claim 1, wherein the locking plate further includes a mushroom-shaped projection; and wherein the base plate has formed through the thickness thereof at least one keyhole slot, the at least one mushroom-shaped projection being receivable in the keyhole-shaped slot and being reciprocatingly slidable therein for securing the locking plate to the base plate.

12. A locking fastener for a strap as defined by claim 1, wherein the base plate includes a front portion and a rear portion situated longitudinally opposite the front portion, the keyhole being formed in proximity to the front portion of the base plate; wherein the first opening in the base plate is situated closer to the rear portion of the base plate than the second opening; wherein the second opening in the base plate is situated closer to the front portion of the base plate than the first opening; and wherein at least a third opening is formed at least partially through the thickness of the base plate in the second surface thereof, the at least third opening being spaced apart from the first opening and the second opening, the at least one protrusion of the locking plate being selectively receivable by the at least third opening as the locking plate slides on the base plate between the at least first position and the second position, the locking plate being positionable with respect to the base plate in at least a third position when the at least one protrusion is received by the at least third opening.

13. A locking fastener for a strap, which comprises:

a base plate having a surface, the base plate further having a pin receiving opening formed through the thickness thereof; and a locking plate having a surface, the 1ocking plate being reciprocatingly slidable with respect to the base plate, the surface of the locking plate facing the surface of the base plate, the locking plate cooperating with the base plate to define the pin receiving opening of the base plate with at least a first dimension and a second dimension, the first dimension of the pin receiving opening being different from the second dimension;

wherein the locking plate further includes a handle extending outwardly from the surface thereof; and wherein the base plate has a handle receiving slot formed through the thickness thereof which extends at least partially longitudinally along the length thereof, the handle of the locking plate being received by the handle receiving slot of the base plate and being reciprocatingly slidable therein.

14. A locking fastener for a strap as defined by claim 13, wherein the locking plate has a forward portion having a recessed edge defining an open pocket, the recessed edge of the locking plate together with the base plate defining the pin receiving opening of the base plate with the at least first and second dimensions.

15. A locking fastener for a strap as defined by claim 13, wherein the locking plate includes at least one mushroom-shaped projection extending outwardly from the surface thereof; and wherein the base plate includes at least one projection receiving slot formed in the surface thereof; the at least one projection receiving slot of the base plate receiving the at least one mushroom-shaped projection of the locking plate to movably secure the locking plate to the base plate.

16. A locking fastener for a strap, which comprises:

a base plate having a surface, the base plate further having a pin receiving opening formed through the thickness thereof; and a locking plate having a surface, the locking plate being reciprocatingly slidable with respect to the base plate, the surface of the locking plate facing the surface of the base plate, the locking plate cooperating with the base plate to define the pin receiving opening of the base plate with at least a first dimension and a second dimension, the first dimension of the pin receiving opening being different from the second dimension;

wherein one of the locking plate and the base plate includes at least one protrusion extending outwardly from the surface thereof, and the other of the locking plate and the base plate includes a first opening formed at least partially through the thickness thereof in the surface thereof, and a second opening formed at least partially through the thickness thereof in the surface thereof, the second opening being spaced apart from the first opening, the at least one protrusion being selectively receivable by one of the first opening and the second opening as the locking plate respectively slides with respect to the base plate between at least a first position and a second position, the locking plate being positionable in the at least first position with respect to the base plate, wherein the locking plate defines the pin receiving opening of the base plate with the first dimension, and the second position with respect to the base plate, wherein the locking plate defines with the base plate the pin receiving opening of the base plate with the second dimension, the first dimension of the pin receiving opening being larger than the second dimension.

17. A locking fastener for a strap, which comprises:

a base plate having a surface, the base plate further having a pin receiving opening formed through the thickness thereof;

a locking plate having a surface, the locking plate being reciprocatingly slidable with respect to the base plate, the surface of the locking plate facing the surface of the base plate, the locking plate cooperating with the base plate to define the pin receiving opening of the base plate with at least a first dimension and a second dimension, the first dimension of the pin receiving opening being different from the second dimension; and a strap buckle, the strap buckle being affixed to the base plate.

18. A locking fastener for a strap, which comprises:

a base plate having a surface, the base plate further having a pin receiving opening formed through the thickness thereof;

a locking plate having a surface, the locking plate being reciprocatingly slidable with respect to the base plate, the surface of the locking plate facing the surface of the base plate, the locking plate cooperating with the base plate to define the pin receiving opening of the base plate with at least a first dimension and a second dimension, the first dimension of the pin receiving opening being different from the second dimension; and a top cover and a bottom cover, the top cover being disposed in overlying relationship to the bottom cover, the locking plate and the base plate being interposed between the top and bottom covers.

19. A locking fastener for a strap as defined by claim 18, which further comprises:

an elongated cover piece, the elongated cover piece being folded upon itself to define the top cover and bottom cover.

20. A locking fastener for a strap as defined by claim 19, which further comprises:

a strap buckle; and wherein the elongated cover piece defines a bore, the strap buckle being partially received by the bore of the elongated cover piece.

* * * * *